United States Patent [19]

Carberry

[11] Patent Number: 4,781,305

[45] Date of Patent: Nov. 1, 1988

[54] SINGLE SHEET PAPER DISPENSER

[76] Inventor: Gerald O. Carberry, 113 Birch St., Schenectady, N.Y. 12303

[21] Appl. No.: 42,830

[22] Filed: Apr. 27, 1987

[51] Int. Cl.[4] ..... B65G 59/00

[52] U.S. Cl. ..... 221/23; 221/43; 221/44; 221/244; 221/259; 271/170

[58] Field of Search ..... 221/23, 22, 42–44, 221/56, 63, 59, 244, 259, 279, 307, 303; 271/121, 169, 170

[56] References Cited

U.S. PATENT DOCUMENTS

| | | | |
|---|---|---|---|
| 363,694 | 5/1887 | Sperry | 221/23 |
| 663,726 | 12/1900 | Carlen | 221/44 |
| 687,343 | 11/1901 | Schilz | 221/43 |
| 2,626,149 | 1/1953 | Holmberg | 271/169 |
| 3,269,590 | 8/1966 | Harter | 221/23 |
| 3,825,249 | 7/1974 | Zimmer | 271/109 |
| 3,907,159 | 9/1975 | Halm | 221/23 |
| 4,189,138 | 2/1980 | Kaneko et al. | 271/109 |
| 4,268,026 | 5/1981 | Kojima | 271/121 |
| 4,363,477 | 12/1982 | Miyashita | 271/170 X |

FOREIGN PATENT DOCUMENTS

| | | | |
|---|---|---|---|
| 100619 | 10/1941 | Sweden | 221/244 |
| 739061 | 10/1955 | United Kingdom | 271/169 |

*Primary Examiner*—Joseph J. Rolla
*Assistant Examiner*—David H. Bollinger
*Attorney, Agent, or Firm*—Schmeiser, Morelle & Watts

[57] ABSTRACT

A single sheet paper dispenser having a tray to hold a stack of paper and a drive assembly which operates as the top sheet of the stack is manually withdrawn to move another single sheet of paper into a feed position whereby it is partly projecting through the open dispensing side of the tray. The dispenser may be used in either a horizontal or a vertical position.

3 Claims, 2 Drawing Sheets

SINGLE SHEET PAPER DISPENSER

BACKGROUND OF THE INVENTION

The present invention relates to a device for dispensing sheets of paper from a stack.

Boxes for holding sheets of paper in a stack are well-known and commonly used. Sheets of paper are manually removed from these boxes which may comprise either a lower housing member or both a lower and an upper housing member connected by a hinge. The main problem with these simple devices is that it is difficult to conveniently remove one sheet of paper at any one time because of friction between the sheets in the stack. For boxes comprising a lower housing member, there is also the problem of scattering sheets of paper since there is nothing to retain them.

Mechanically more complex dispensing devices have been developed to overcome the shortcomings of the prior art. A necessary element of these devices is generally an upper housing member. One such device is Halm, U.S. Pat. No. 3,907,159 which employs an annular body mounted on the upper housing member of the box. The annular body is compressed by the upper and lower housing members so that it will engage sheets of paper and move them into a narrow dispensing slot as they are pulled out by hand. In addition, the aforementioned device consists of a shelflike projection located at the dispensing slot upon which a sheet of paper may rest so that only one sheet is dispensed at a time. One drawback of an apparatus of this type is that the dispensing slot is so narrow that there is the possibility of bunching paper inside the box. Another drawback is its lack of versatility in that both an upper and lower housing are required in order for the dispenser to function properly, and the requirement that the device must rest horizontally with the bottom of the lower housing member in contact with the desk or other object on which it is placed.

It is, therefore, an object of the present invention to provide a new and improved dispensing device for dispensing sheets of paper from a stack one at a time.

Another object of this invention is to provide a versatile paper dispensing device which performs the same dispensing function while positioned either horizontally or vertically.

Another object of this invention is to provide a new and improved paper dispensing means, with easy access to the paper supply.

Another object of this invention is to provide a single sheet paper dispenser which will efficiently prevent more than one sheet at a time from being dispensed.

Objects and advantages of the invention are set forth in part herein and inpart will be obvious herefrom, or may be learned by practice with the invention, the same being realized and attained by means of the instrumentalities and combinations pointed out in the appended claims.

This invention consists in the novel parts, constructions, arrangements, combinations and improvements herein shown and described.

SUMMARY OF THE INVENTION

In accordance with the aforesaid objectives of the present invention, an improved single sheet paper dispenser has been developed. A stack of paper is held in a tray into which a drive assembly is inserted. Adventageously, the tray is configured to receive the assembly in such a way to enable the user to use the dispenser with the tray positioned either horizontally or vertically. In either position, manually withdrawing the top sheet of paper from the stack causes the drive assembly to move the next sheet into a feed position so that it partly projects out of the open dispensing side of the tray for easy removal. In addition, to prevent the feeding of more than one sheet at a time, the tray includes elements which retard the forward motion of sheets in the stack.

The accompanying drawings referred to herein and constituting a part hereof illustrate preferred embodiments of the invention and together with the description, serve to explain the principles of the invention.

DETAILED DESCRIPTION OF THE DRAWINGS

Figure 1:
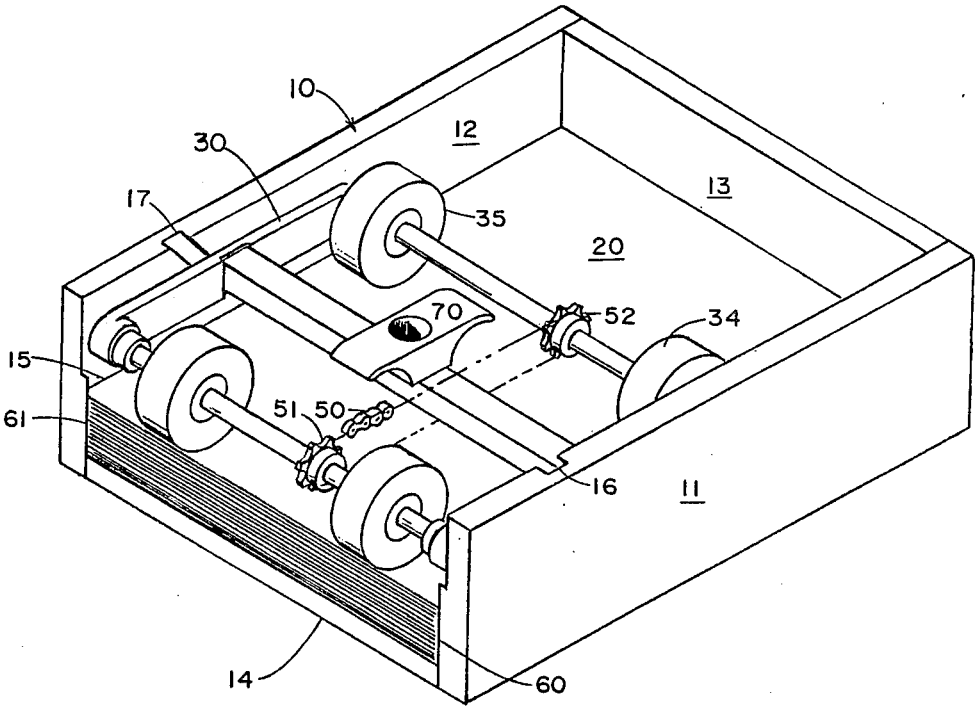
FIG. 1 is an oblique view of the invention.

With reference to FIG. 1, the tray 10 of the preferred embodiment of the present invention holds sheets of paper in a stack 20 to be dispensed one at a time. The tray 10, made of rigid plastic or any other suitable material, has four closed sides: two sidewalls 11, and 12; a rear side 13; and a bottom 14. Sheets of paper are manually withdrawn through an open dispensing side 15.

Figure 2:
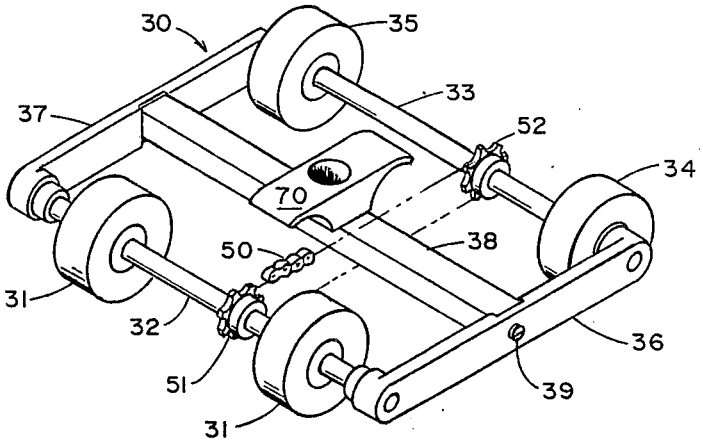
FIG. 2 is an oblique view of the drive assembly.

With reference to FIG. 2, a floating drive assembly 30 consists of a lead drive and a follower drive. In the preferred embodiment, the lead drive has a pair of wheels 31 mounted on a lead axle 32. The follower drive has two wheels 34, 35 mounted at either end of a follower axle 33 which is parallel to the lead axle 32. Distances between axles 32, 33 is determined by the degree to which the paper is to be dispensed. It should be appreciated that by using extensible side members 36 and 37 the length of the side members may be varied, then, by adding or removing links in roller chain 50 one may alter the extent to which the second sheet of paper is advanced. The parallel axles 32, 33 are connected to each other at their ends by perpendicular side members rails 36, 37. Also interconnecting the lead and follower driver are mechanical means for transmitting a motive force from the lead drive to the follower drive. In the preferred embodiment as shown in the drawings, sprockets 51, 52 are mounted on each axle and are interconnected by a roller chain 50. Although other mechanical arrangements may be used, such as a belt and pulley or a gear train or the like, the roller chain arrangement is used in the preferred embodiment to minimize friction in the drive. Additionally, for support, a brace 38 is mounted between the side members so that it is parallel to axles 32, 33. A screw 39 not only secures the brace 38 but also protrudes beyond the side member. Another screw 39 (not shown) is identical to screw 39 but on the opposite side of the drive assembly.

As shown in FIG. 1 the floating drive assembly 30 fits by means of screws 39 or any other appropriate projection as guide-followers, into slots 16, 17. the handle 70 is mounted on brace 38 for easy insertion and removal of drive assembly 30. Advantageously, the weight of the drive assembly 30 is guided toward the stack 20 by the screws 39, sliding in the slots 16, 17 so that even pressure is applied to the stack 20. Because gravity provides the friction between the drive assembly and the stack of paper the pressure remains constant whether the dispenser is full or if only one or two sheets remain. Thus, consistent, positive dispensing is obtained with each use. Slots 16, 17 are formed in the tray 10 at an angle of 15–80 degrees from the perpendicular with the preferred angle being 25 degrees, to the bottom of tray 10. This slot arrangement results in easy access to the paper supply as well as the ability to use the dispenser in either a horizontal position resting on the bottom 14 of tray 10 or in a vertical position resting on its rear side 13. In either position, the force of gravity pulls the drive assembly 30 downward toward the stack 20.

When the top sheet of the stack 20 is withdrawn manually through the open dispensing side 15 of the tray 10, the force of friction between the drive wheels 31, 34, 35 and the stack 20 causes the drive wheels 31, 34, 35 to rotate. To increase the frictional forces between the drive wheels 31, 34 and 35 and the paper, each wheel is provided with an outer cover comprising a rubber belt or the like. As the rear edge of the top sheet moves past the follower drive, the follower wheels 34, 35 continue to rotate due to the transmission of the motive force of the lead drive to the follower drive through the roller chain 50. The follower wheels 34, 35 then frictionally engage the second sheet of the stack 20 and drive it forward through the open dispensing side 15 of the tray 10. Rotation of drive wheels 31, 34, 35 ceases when the top sheet of paper is completely withdrawn. At this point, the second sheet has been advanced into the feed position, i.e. partly projecting through the open dispensing side 15 of tray 10, for easy access.

In order to prevent dispensing more than one sheet of paper at a time, the preferred embodiment of the present invention includes flanges 60, 61 fixed to the forward edges of sidewalls 11, 12. Flanges 60, 61, are made of plastic or other suitable material, each has a lip which extends into the open dispensing side 15 of tray 10. The lips are sufficiently small so as to prevent the premanent deformation of paper as it is driven out; however, the force of friction between the second and third sheets of the stack 20 is insufficient to overcome the retarding force of flanges 60, 61, thus preventing a double-sheet feed. In an alternate embodiment, sponges or other suitable resilient materials may be fixed to the inner portions of sidewalls 11, 12 to retard the forward motion of sheets.

While the above description discloses the preferred embodiment of the invention, it is anticipated that changes may be made without departing from the concepts disclosed herein and therefore, it is intended that the scope of this invention be limited only by the appended claims.

What is claimed is:

1. A single sheet paper dispenser comprising:

a tray adapted to hold a stack of paper, said tray having a bottom, an open dispensing side through which creaseless sheets of paper are manually withdrawn one at a time, two sidewalls each including a diagonal guide-slot formed therein, and a rear side opposite said open dispensing side;

means for retarding the forward motion of sheets in said stack so as to prevent feeding more than one sheet at a time, said retarding means including flanges fixed to the forward edge of each of the two sidewalls of said tray, said flanges each having a lip which extends into the open dispensing side of said tray;

a floating drive assembly including a first set of wheels mounted on a lead axle and a second set of wheels in tandem registry therewith mounted on a follower axle, said floating drive assembly further comprising a roller chain entrained about said lead and follower axles for transferring rotary motion from said first set of wheels to said second set of wheels, said lead and follower axles being mounted on parallel carriage side rails and having a brace mounted orthogonally between said side rails, said brace being parallel to the lead and follower axles, said brace further having projections from the ends of said brace beyond said rails for slidable insertion into said diagonal slots, whereby the weight of said assembly is applied evenly to and directed toward the stack of paper by gravity as said projections slide in said diagonal guideslots when said tray is positioned horizontally resting on said bottom or vertically resting on said rear side.

2. The invention of claim 1 wherein said diagonal guide-slots formed in the sidewalls of said tray extend at a 15°–80° angle from a line perpendicular to the bottom of said tray toward the rear side.

3. The invention of claim 1 wherein said means for retarding the forward motion of sheets in said stack comprises a resilient material fixedly attached to the inside portion of each of the two sidewalls of said tray

* * * * *